US005579617A

United States Patent [19]

Schiedegger et al.

[11] Patent Number: 5,579,617

[45] Date of Patent: Dec. 3, 1996

[54] DENTIL MOLDING APPARATUS AND METHOD FOR SECURING A MOLDING INSERT MEMBER

[75] Inventors: Charles E. Schiedegger, Metamora; Aundrea Nurenberg, Lapeer; Richard J. MacLeod, Milford; Michael C. Clark, Columbiaville; J. Richard Logan, Oxford, all of Mich.

[73] Assignee: Tapco International, Plymouth, Mich.

[21] Appl. No.: 351,796

[22] Filed: Dec. 8, 1994

[51] Int. Cl.[6] ..... F04B 2/00

[52] U.S. Cl. ..... 52/288.1; 52/287.1; 52/718.04; 52/94

[58] Field of Search ..... 52/94, 95, 288.1, 52/287.1, 718.01, 718.04, 716.1, 255

[56] References Cited

U.S. PATENT DOCUMENTS

| | | | |
|---|---|---|---|
| Re. 34,547 | 2/1994 | Weldy | 52/716.1 X |
| 3,181,275 | 5/1965 | Schroter et al. | 52/94 X |
| 3,464,177 | 9/1969 | Amato | 52/288.1 |
| 3,834,104 | 9/1974 | Dunn et al. | 52/94 X |
| 3,975,875 | 8/1976 | Goss, Jr. | 52/288.1 |
| 4,000,597 | 1/1977 | Burton | 52/716.1 |
| 4,091,586 | 5/1978 | Schwartz . | |
| 4,461,128 | 7/1984 | Knoebl | 52/94 |
| 4,875,318 | 10/1989 | MacLeod et al. . | |
| 4,956,950 | 9/1990 | Hirose | 52/94 |
| 5,001,877 | 3/1991 | Edwards | 52/288.1 |
| 5,195,283 | 3/1993 | MacLeod et al. . | |
| 5,243,793 | 9/1993 | MacLeod et al. . | |
| 5,243,800 | 9/1993 | Olbrich | 52/287.1 X |
| 5,315,799 | 5/1994 | Cullinan | 52/94 X |
| 5,336,849 | 8/1994 | Whitney | 52/287.1 X |
| 5,433,048 | 7/1995 | Strasser | 52/288.1 |

*Primary Examiner*—Carl D. Friedman
*Assistant Examiner*—Winnie Yip
*Attorney, Agent, or Firm*—Harness, Dickey & Pierce, P.L.C.

[57] ABSTRACT

A molding assembly having a hanger member fixedly securable to an inner or outer wall of a building and a decorative molding insert member releasably engageable with the hanger member. The molding insert member is supported at a lower edge portion by a lower J-channel of the hanger member. An upper L-shaped portion of the insert member is supported by a depending lip portion of the hanger member which forms a second channel such that no external fastening elements are required to secure the molding insert member to the hanger member. The insert member can be quickly and easily releasably engaged within the J-channel and the second channel without the need for special tools. In an alternative preferred embodiment the insert member includes a lip portion which is adapted to slidably engage an under surface of an adjacently positioned insert member to provide an even more continuous appearance for adjacently positioned insert members. An end cover is also disclosed for covering an exposed end portion of the molding assembly when the end portion is secured to a section of a wall where one or more ends of the molding assembly do not abut another wall portion extending perpendicularly from the molding assembly. In an alternative embodiment of the end cover, the end cover includes a shoulder portion formed to protrude from a lower lip portion which engages a notch formed in a lip of a lower J-channel of a hanger member of the present invention. In this manner, once the end cover is releasably secured to the hanger member, the end cover cannot be slidably urged-off of the hanger member such as by thermal expansion of one or more sections of molding insert members.

23 Claims, 11 Drawing Sheets

FIG 1
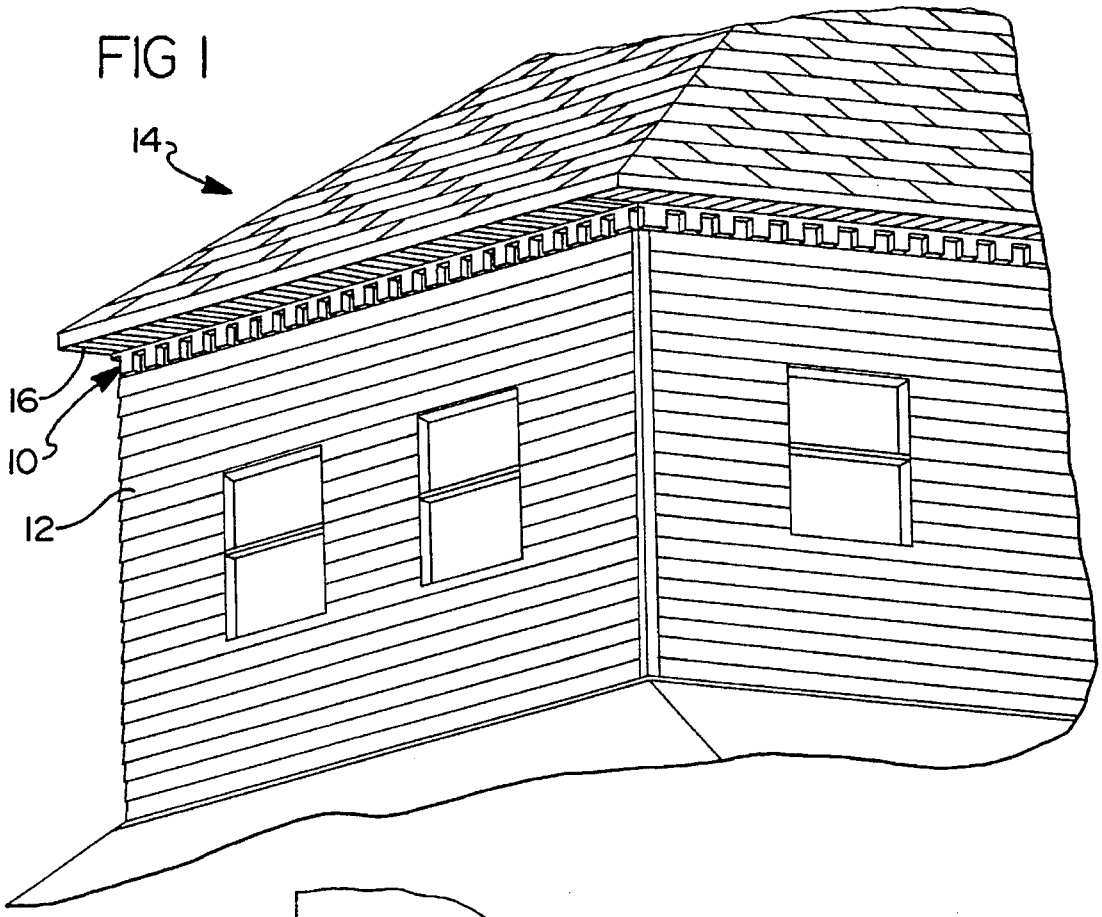
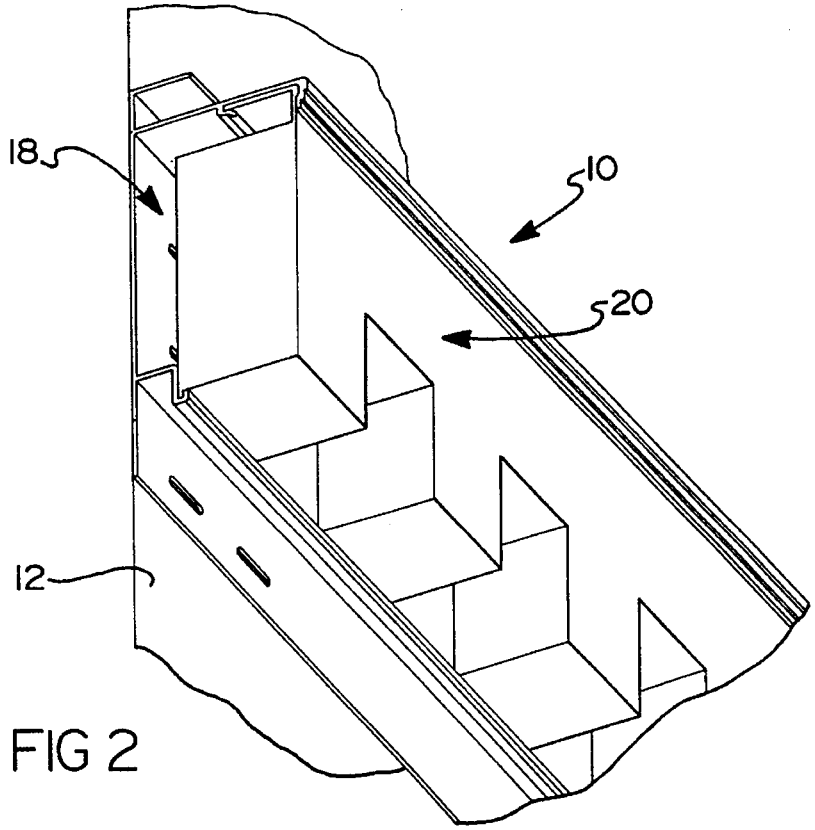
FIG 2

FIG 7
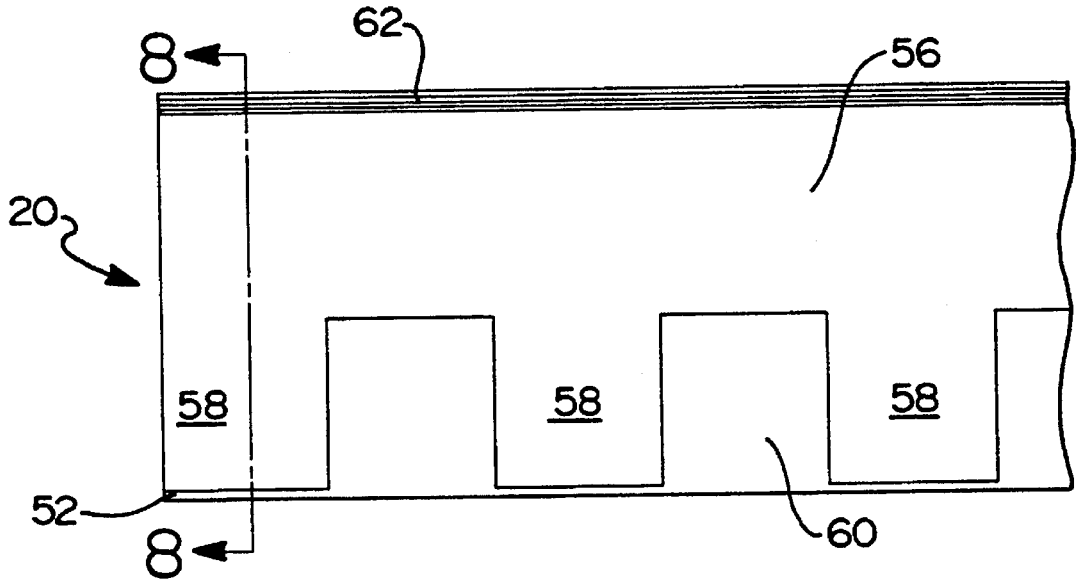
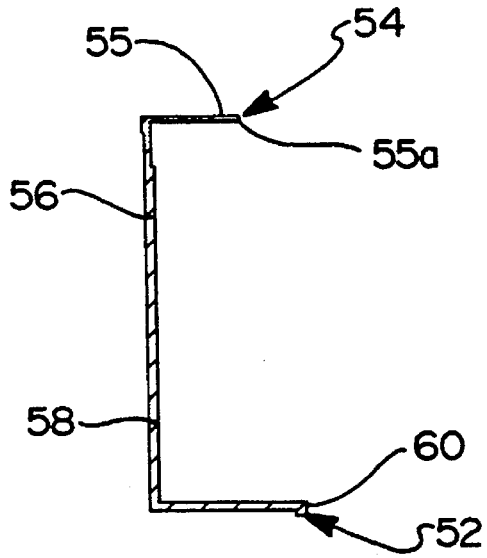
FIG 8

FIG 9
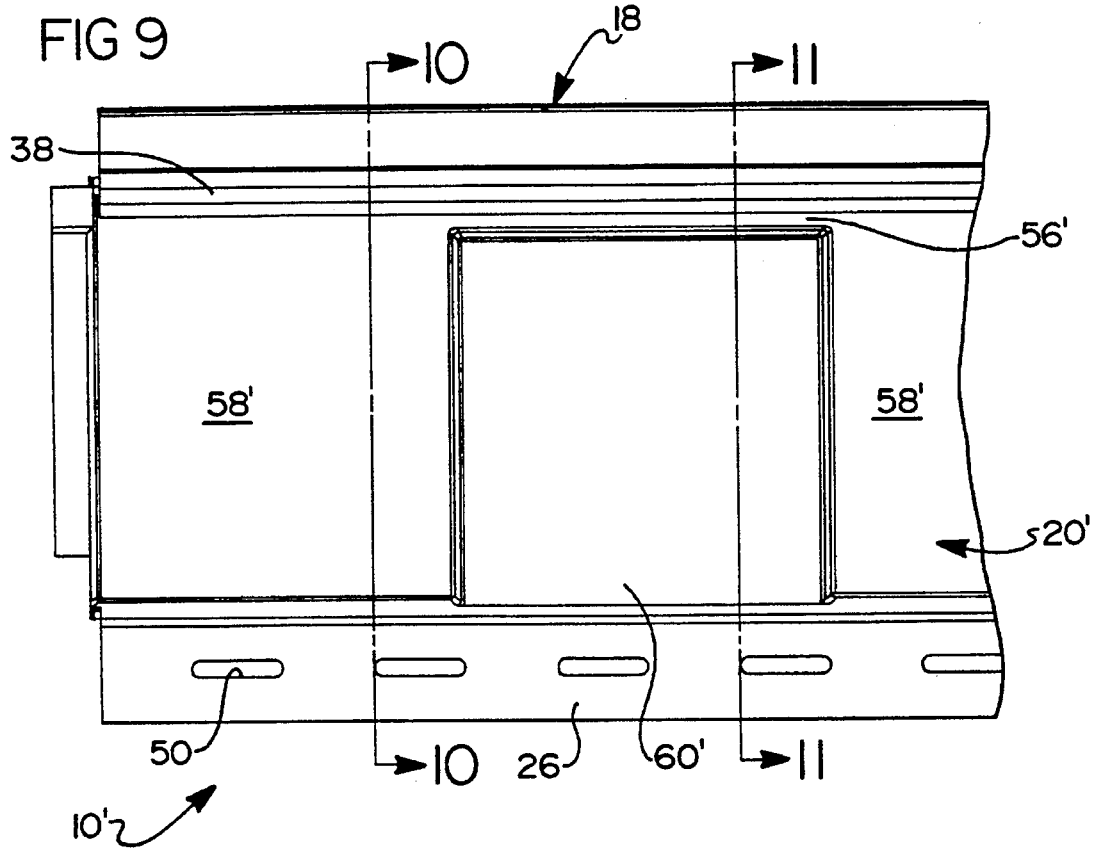
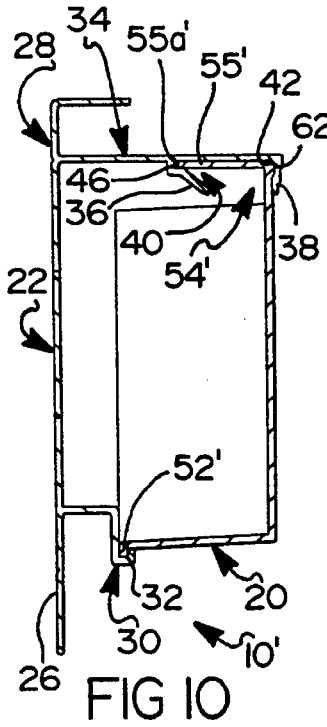
FIG 10
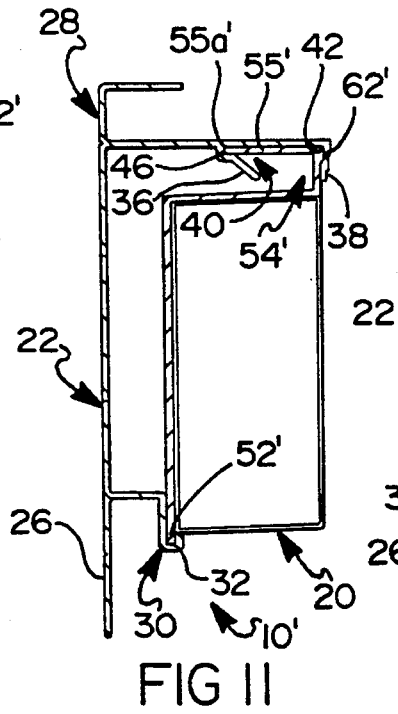
FIG 11
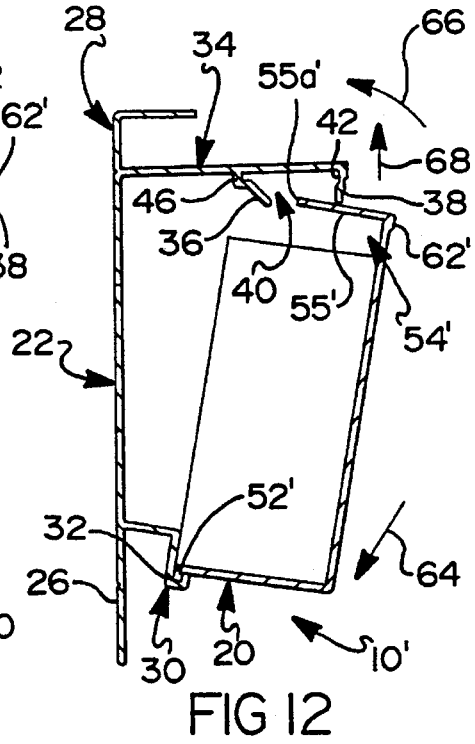
FIG 12

FIG 18
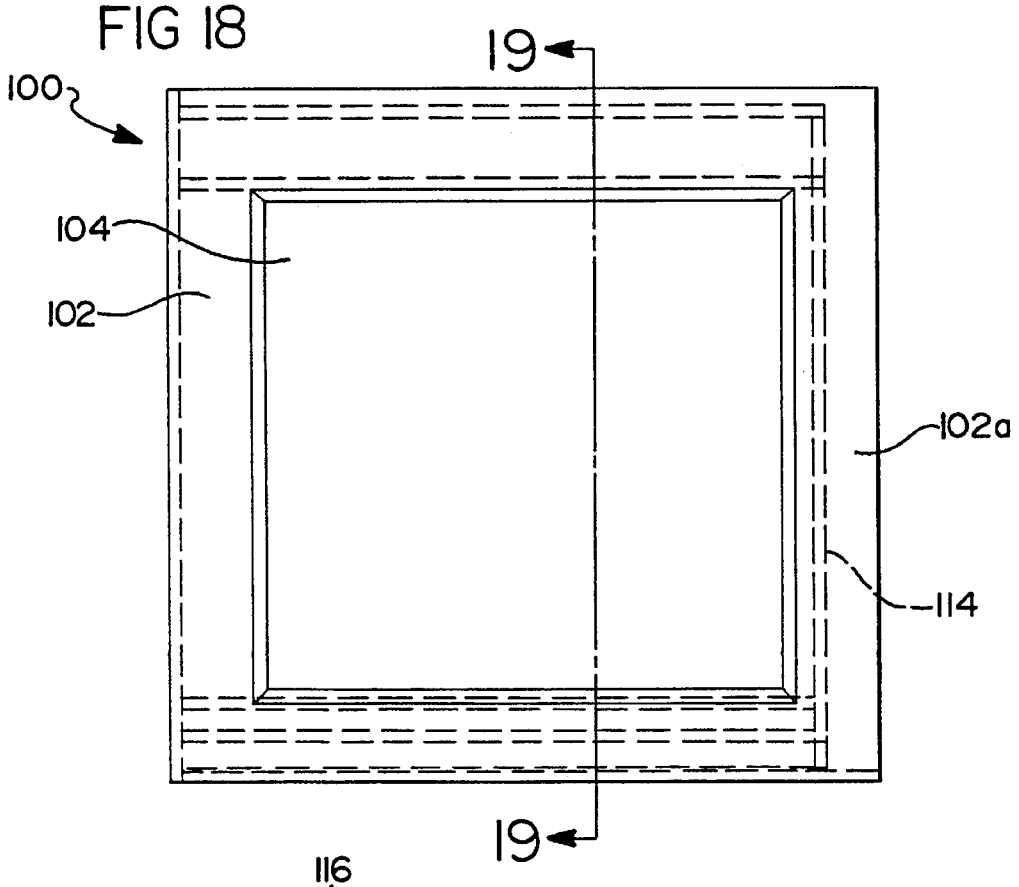
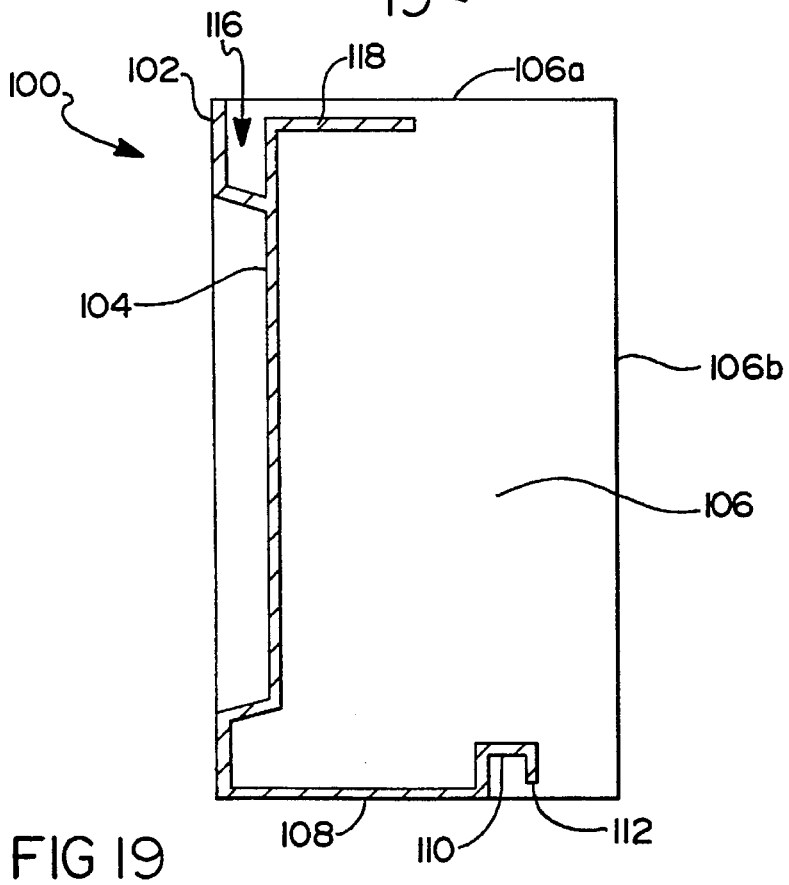
FIG 19

FIG 20
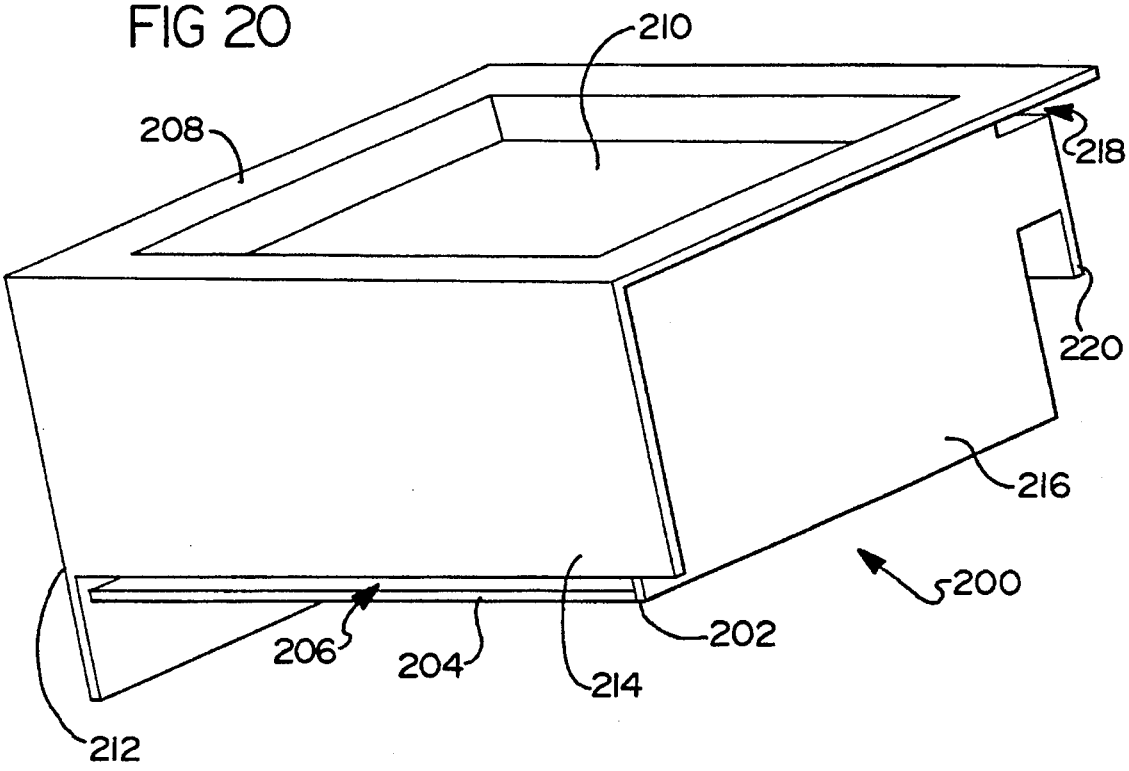
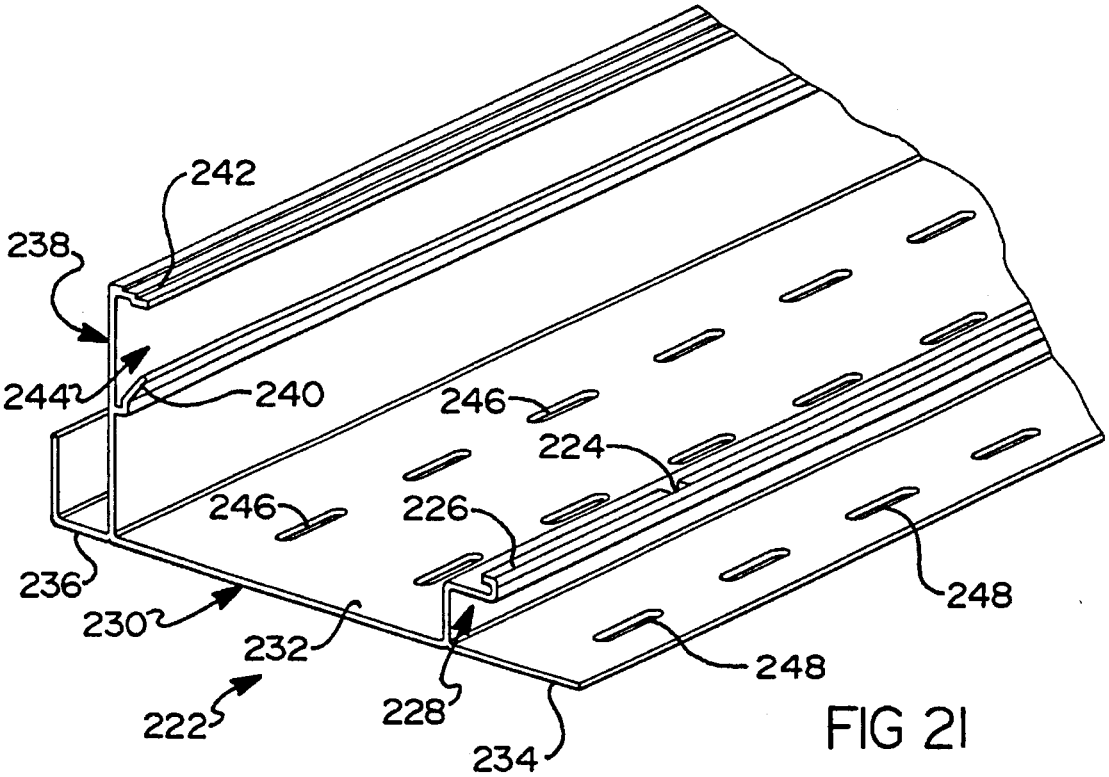
FIG 21

FIG 22
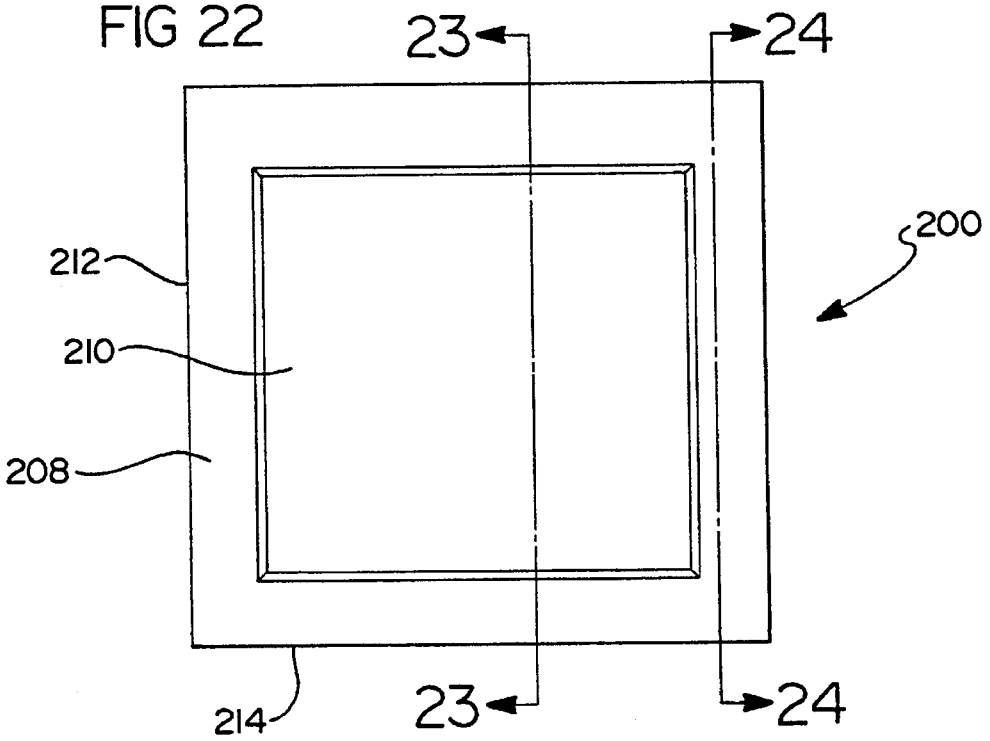
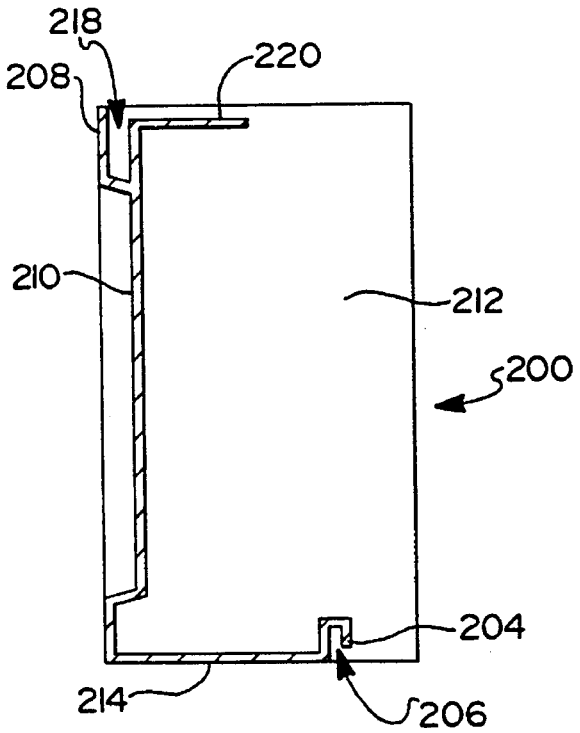
FIG 23
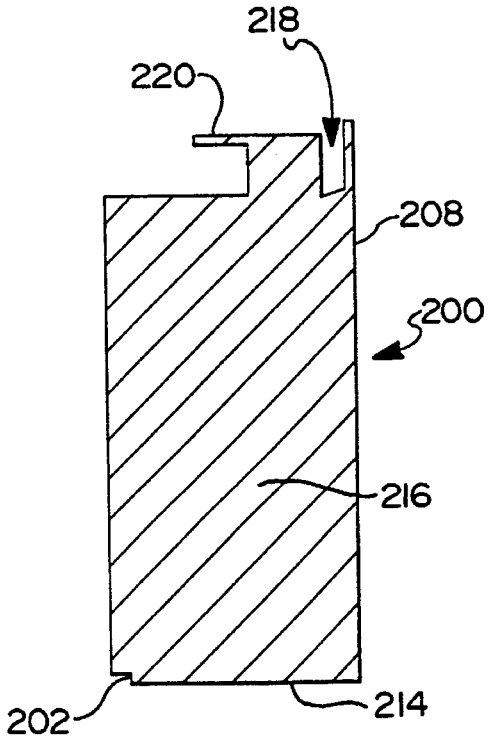
FIG 24

FIG 25
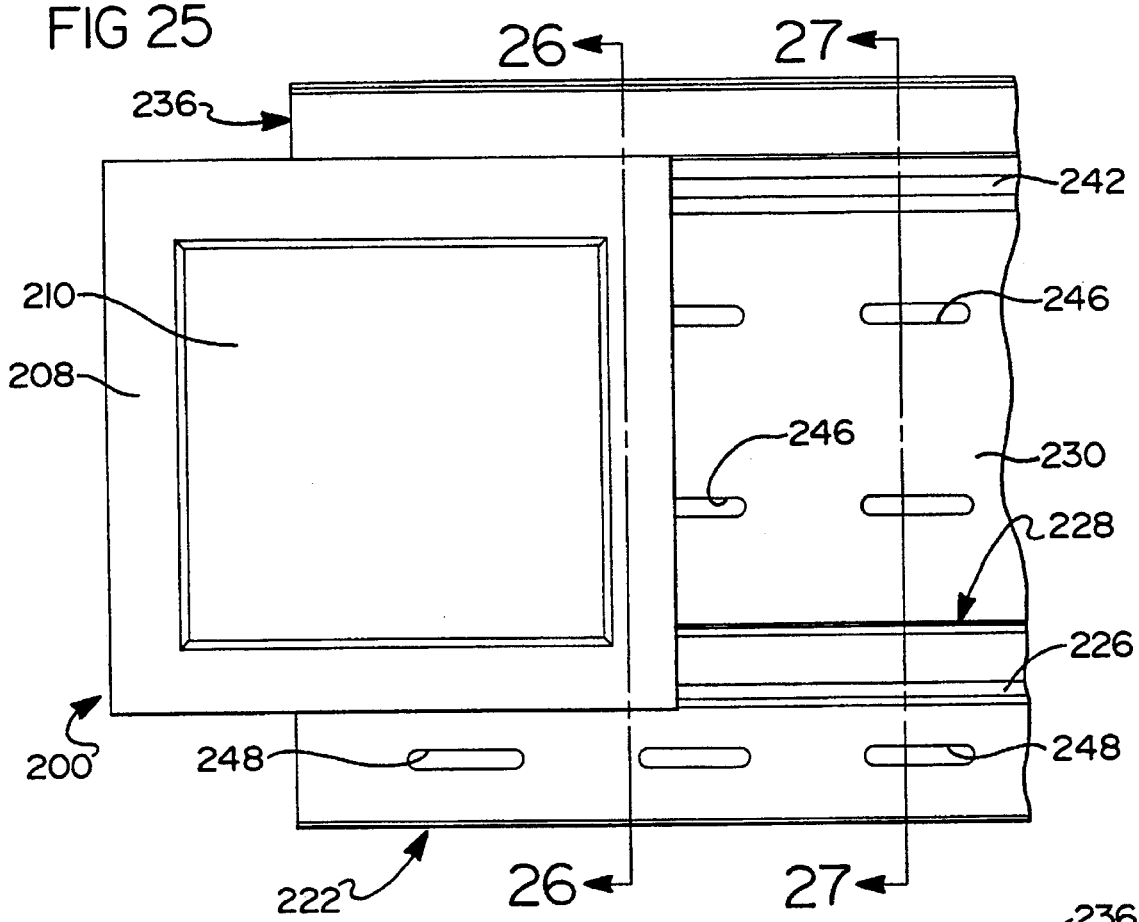
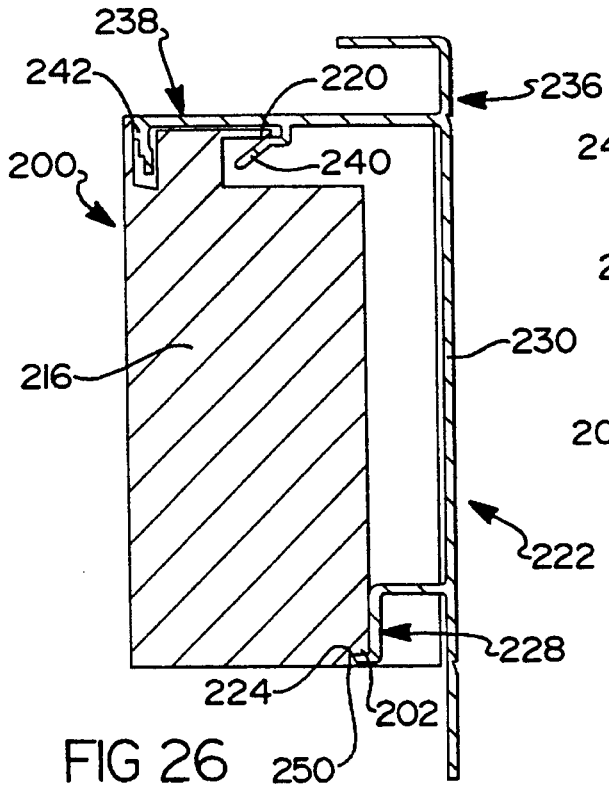
FIG 26
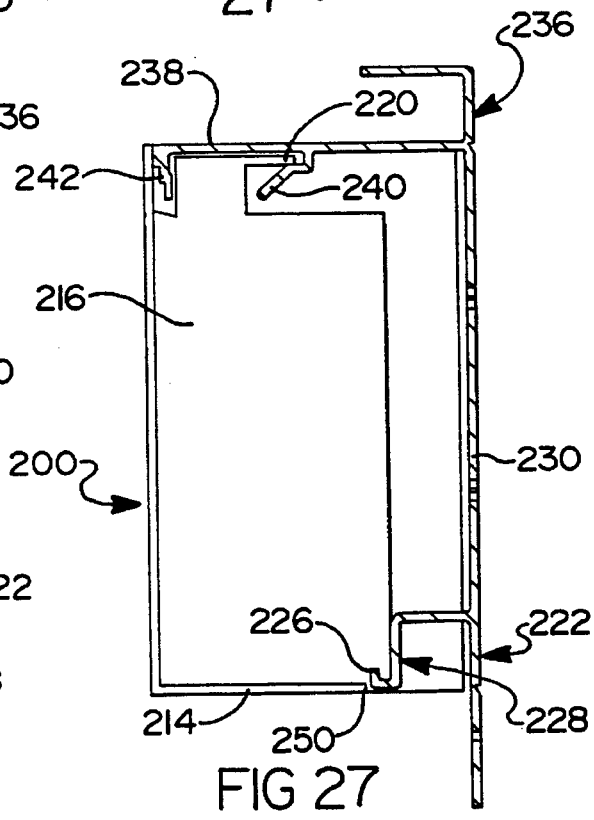
FIG 27

DENTIL MOLDING APPARATUS AND METHOD FOR SECURING A MOLDING INSERT MEMBER

BACKGROUND OF THE INVENTION

1. Technical Field

This invention relates to molding assemblies, and more particularly to a molding apparatus having a hanger member and a decorative insert member adapted to be secured to the hanger member without the use of independent fastening elements, to thereby form an easily installable molding assembly for a residential or commercial building.

2. Discussion

On buildings it is often desirable to include some form of decorative molding along the interior of a room of the building or along an exterior of the building where a vertical wall and soffit adjoin. Traditionally, such moldings have been manufactured from wood or urethane foam and secured either to interior corners of a room or along an exterior of a home or building by the use of nails, staples, etc. This method of attaching molding, as well as the materials required to make the molding, has several drawbacks. For one, moldings manufactured from wood or urethane have become extremely expensive due to the increasing cost of these materials. Secondly, since the moldings have traditionally been secured via nails or staples, the added step of patching over nail holes with putty, sanding and painting or staining has represented a significant cost in terms of labor and the time required to install such moldings. Lastly, traditional interior and exterior architectural decorative moldings manufactured from wood are subject to shrinkage, warping and splitting which can give rise to significant maintenance costs when such moldings are secured to the exterior of a residential dwelling or commercial building.

In some applications, it would also be desirable to removably secure a molding insert member at both its upper and lower edges to a hanger member, where the hanger member has been previously secured to a wall portion. Such an attachment of the molding insert member would even further resist environmental factors which might cause detachment of the molding insert member.

In view of the above, it is a principal object of the present invention to provide a molding assembly having a track member which may be secured to an interior or exterior wall and an independent, decorative molding insert member which may be quickly and easily secured to the hanger member at both its upper and lower edge portions to thereby even more securely affix the molding member to the wall, and without the need for independent fastening elements to secure the molding member to the hanger member.

It is yet a further object of the present invention to provide a molding assembly having a hanger member and an independent, decorative molding insert member in which the insert member can be engaged via a snap fit within a pair of spaced apart channels of the hanger member to cause the insert member to be supported along both its upper and lower edges, to thereby further improve the degree to which the insert member is secured to the hanger member.

It is still another object of the present invention to provide a track member which may be extruded from a thermoplastic and a decorative molding insert member which may be injection molded or vacuum formed from a thermoplastic to provide a relatively low cost, high quality appearance molding assembly providing the appearance of hardwood molding.

SUMMARY OF THE INVENTION

The above and other objects are provided by a molding apparatus and method in accordance with preferred embodiments of the present invention. The apparatus of the present invention generally includes a hanger member adapted to be fixedly secured to an interior or exterior wall. The hanger member includes a first channel and a second channel spaced apart from the first channel. An insert member in the form of a decorative molding insert member has a first portion which is engageable within the first channel and a second portion spaced apart from the first portion which is engageable within the second channel, to thus enable the molding member to be supported at two-spaced apart locations by the hanger member.

In a preferred embodiment the hanger member includes a back member having an integrally formed lower J-channel which forms the first channel and an integrally formed upper lip member which forms the second channel. The back member preferably includes a plurality of apertures for allowing it to be secured via conventional nails, threaded screws or the like to the wall. The lower J-channel and the upper lip member are both at least slightly flexible to enable the molding insert member to be inserted into the first and second channels with a minimum degree of force, but yet held securely to the hanger member once inserted and coupled to the hanger member.

In a preferred embodiment of the present invention, the upper lip member of the insert member includes an inner lip member and an outer lip member which form the second channel. In this embodiment the hanger member includes a lower J-channel which accepts a lower edge portion of the molding insert member. The upper lip member is adapted to engage an upper L-shaped portion of the molding insert member. The molding insert member is thus secured at both its upper and lower portions to the hanger member without the use of independent fastening elements such as nails, staples, threaded screws or the like.

A preferred method of the present invention comprises securing a hanger member having a first channel and a second channel spaced apart from the first channel to an interior or exterior wall. An independent molding insert member having a first edge portion and a second edge portion spaced apart from the first edge portion is then positioned such that the first edge portion is placed within the first channel of the track member. A force is then exerted against the insert member such that the first channel is moved slightly away from the second channel. While the insert member is held with the first channel urged slightly away from the second channel, the insert member is rotated such that the second edge portion is urged into the second channel. The pressure on the molding member is then released which causes the first channel and the molding member to be urged slightly towards the second channel, thus causing the molding member to become engaged within the second channel and held securely within the first and second channels.

In an alternative preferred embodiment of the present invention the decorative molding insert member includes an edge protruding lip which is adapted to extend underneath an adjacent insert member secured to the same hanger member. In this manner, when adjacently positioned insert members secured to the same hanger member are positioned abuttingly against one another, a more continuous-appearing insert member is formed.

In another alternative preferred embodiment of the present invention a molding assembly is provided which includes an end cover adapted to close-off a terminal end of a molding insert when the terminal end does not abut a perpendicularly extending wall portion, and would therefore be exposed to view. The end cover is adapted to be snappingly engaged to a hanger member such that when secured to the hanger member, a portion of the end cover extends rearwardly into abutting contact, or at least close to abutting contact, with the wall portion to which the hanger member is secured. In this manner, the terminal end of the molding assembly is closed-off to present a more decorative and finished appearance where no perpendicular wall extends close to the terminal end portion of the molding assembly.

In yet another alternative preferred embodiment of the present invention, a molding assembly having an end cap is disclosed where the end cap includes a shoulder portion adapted to engage within a notch formed in a hanger member of the molding assembly. The end cover closes-off the terminal end of the molding assembly where no perpendicularly extending wall portion is present at the terminal end of the molding assembly. The shoulder portion and notch cooperate when the end cover is secured to the hanger member of the molding assembly to prevent the end cover from being slidably forced off of the hanger by thermal expansion or other factors. Accordingly, once the end cover is secured to the hanger member and cannot be slidably removed from the hanger member, it must be disengaged by manually urging it outwardly of the hanger member in a fashion opposite to the manner in which it is installed on the hanger member.

The preferred embodiments of the present invention thus provide a molding assembly which securely supports a decorative molding member at two edges thereof to even more securely position a molding insert member along the corner of an interior or exterior wall. In one preferred embodiment, the track member of the molding apparatus is extruded from a plastic, while the molding member is injection molded or vacuum formed from a thermoplastic. The molding assembly thus forms a relatively low cost apparatus which provides the appearance of a hardwood molding, but without the drawbacks associated with the use of real wood or urethane foam and the added complexity of installation of previously developed plastic molding assemblies.

BRIEF DESCRIPTION OF THE DRAWINGS

The various advantages of the present invention will become apparent to one skilled in the art by reading the following specification and subjoined claims and by referencing the following drawings in which:

FIG. 1 is a perspective view of a portion of an exterior of a building showing the molding apparatus of the present invention secured to an exterior wall closely adjacent a soffit of the building;

FIG. 2 is a perspective view of the molding apparatus showing the molding insert member secured to the hanger member;

FIG. 7 is a plan view of a portion of the molding insert member;

FIG. 8 is a cross-sectional view of the insert member of FIG. 6 taken in accordance with section line 8—8 of FIG. 7;

FIG. 9 is a plan view of a portion of an assembled molding assembly in accordance with an alternative preferred embodiment of the present invention;

FIG. 10 is a cross-sectional side view of the molding assembly of FIG. 9 taken in accordance with section line 10—10 of FIG. 9;

FIG. 11 is a cross-section side view of the molding assembly of FIG. 9 taken in accordance with section line 11—11 of FIG. 9;

FIG. 12 is a cross-sectional end view of the molding assembly of FIG. 10 showing how the molding insert member is rotatably urged into engagement with the hanger member;

FIG. 18 is a front view of the end cover of FIG. 16;

FIG. 19 is a cross-sectional side view of the end cover in accordance with section line 19—19 in FIG. 18;

FIG. 20 is a perspective view of an alternative preferred embodiment of the end cap of the molding assembly of the present invention;

FIG. 21 is a perspective view of a portion of a hanger member in accordance with an alternative preferred embodiment of the molding assembly of the present invention;

FIG. 22 is a front view of the end cover of FIG. 20;

FIG. 23 is a side cross-sectional view of the end cover shown in FIG. 22 in accordance with section line 23—23 in FIG. 22;

FIG. 24 is a side cross-sectional view of the end cover of FIG. 22 in accordance with section line 24—24 in FIG. 22;

FIG. 25 is a front view of the end cover of FIG. 20 releasably secured to the hanger member of FIG. 21;

FIG. 26 is a side cross-sectional view of the molding assembly shown in FIG. 25 taken in accordance with section line 26—26 in FIG. 25; and FIG. 27 is a side cross-sectional view of the molding assembly shown in FIG. 25 taken in accordance with section line 27—27 in FIG. 25.

DETAILED DESCRIPTION OF THE PREFERRED EMBODIMENTS

Figure 3:
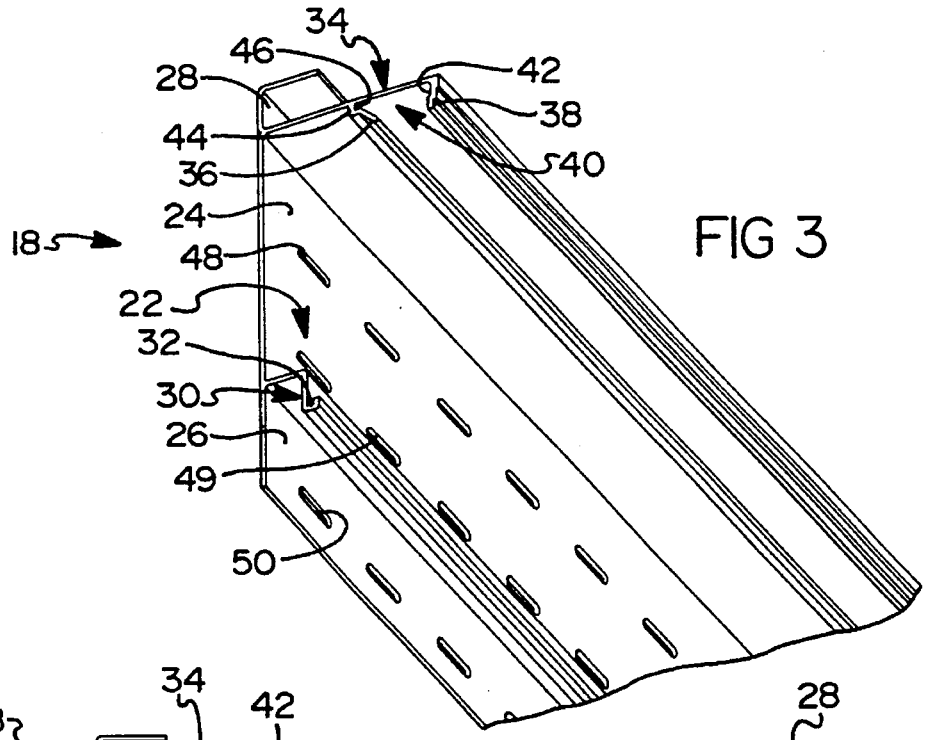
FIG. 3 is a perspective view of only the hanger member.

Referring to FIG. 1, there is shown a decorative, dentil molding apparatus 10 in accordance with a preferred embodiment of the present invention secured to an exterior wall 12 of a residential dwelling 14 closely adjacent a soffit 16 of the dwelling 14. It will be appreciated immediately, however, that the molding apparatus 10 is equally well suited to be secured to an interior wall of a residential dwelling or commercial building, as well as an exterior wall of a commercial building with little or no modification to the apparatus 10. For purposes of illustration only, the molding apparatus 10 will be described as being secured to the exterior wall 12 of the dwelling 14 at the area where the exterior wall 12 and soffit 16 meet. It will also be appreciated that while the molding apparatus 10 will be described and illustrated herein as including a dentil molding insert member, that a wide variety of decorative molding insert members such as "ogee" molding insert members could be just as easily used with the present invention.

With reference to FIG. 2, the assembled molding apparatus 10 is shown secured to the wall 12 of the building 14. For clarity, the soffit 16 of the building 14 has not been illustrated, nor have any siding strips of the building 14. The molding assembly 10 generally comprises a hanger member 18 and an independent, decorative dentil molding insert member 20 which is releasably securable to the hanger member 18.

Figure 4:
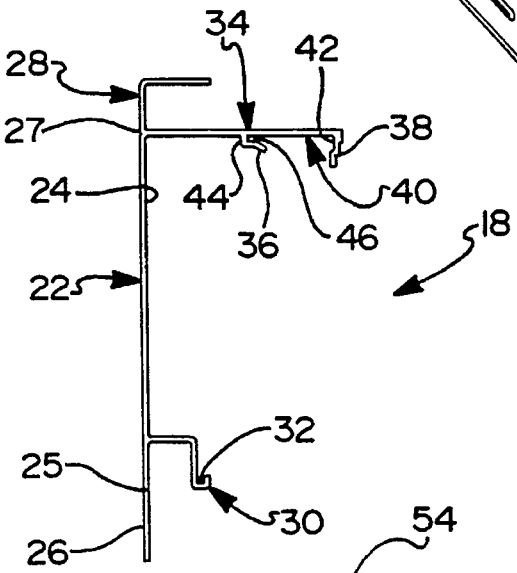
FIG. 4 is an end view of the hanger member shown in FIG. 3.
Figure 5:
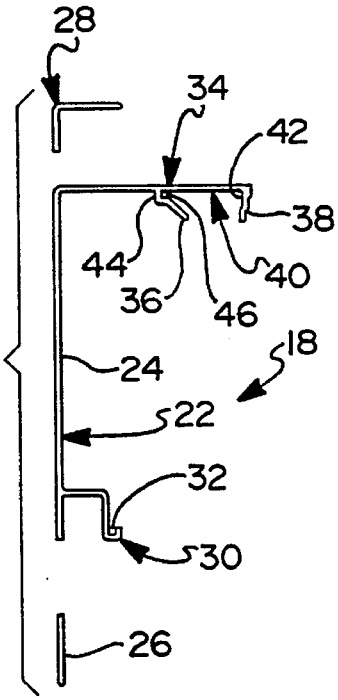
FIG. 5 is an end view of the hanger member showing the lower portion and the soffit-engaging upper lip portion detached from the central portion.

Referring to FIGS. 3 and 4, the hanger member 18 is shown without the molded dentil insert member 20 secured thereto. The hanger member 18 comprises a back member 22 having a central portion 24, an optional lower portion 26 and an optional soffit-engaging upper lip portion 28. The central portion 24 and the lower portion 26 are separable at a lower V-groove 25 and the soffit-engaging upper lip portion 28 and central portion 24 are separable at an upper V-groove 27. The V-grooves 25 and 27 are formed during manufacture of the hanger member 18 to represent areas which may be "scored" with a utility knife or like instrument to allow the lower portion 26 and the soffit-engaging lip portion 28 to be broken away by subsequent bending or flexing of these portions when either (or both) is not needed. Such a situation would be present when, for example, the hanger 18 is secured to an outer wall having a brick exterior. In this instance, since no siding strips would be present to cover the lower portion 26, the lower portion 26 may simply be removed and the hanger member 18 positioned and secured to the wall such that the lower V-groove 25 is positioned abuttingly against the top-most row of bricks. Similarly, where the hanger member 18 does not need to engage a soffit, the soffit-engaging lip portion 28 may be removed so that the hanger member 18 can be abuttingly positioned and secured against a surface of a perpendicularly extending overhang of a building of an interior ceiling wall. The hanger member 18 having its lower portion 26 and soffit-engaging lip portion 28 separated from the central portion 24 is shown in FIG. 5.

With further reference to FIGS. 3 and 4, integrally formed with the back member 22 of the hanger member 18 is a lower J-channel 30 forming a first channel 32 and a depending upper lip member 34. The upper lip member 34 includes an inner lip member 36 and an outer lip member 38 which together help form a second channel 40 which is spaced apart from the first channel 32. The outer lip member 38 further includes a first groove 42, while the inner lip member 36 includes a corner portion 44 forming a second groove 46.

With further specific reference to FIG. 3, the central portion 24 of the hanger member 18 preferably includes a first plurality of spaced apart, somewhat elongated apertures 48 and a second plurality of longitudinally offset, elongated apertures 49, while the lower portion 26 similarly includes a third plurality of spaced apart, elongated apertures 50. The groups of apertures 48, 49 and 50 enable the hanger member 18 to be secured to the outer wall 12 via a plurality of nails, wood screws or like fastening members which are preferably inserted through the longitudinal center of the apertures 48, 49 and 50. Offsetting the second plurality of apertures 49 from the first plurality 48 enables the hanger member 18 to be even more completely secured to the outer wall 12 in such a manner that the back member 22 thereof is held flush against the surface of the outer wall 12. During securing of the hanger member 18, external fasteners such as nails or screws are driven in to the wall portion 12 through the apertures 48 and 49 such that the fasteners are preferably staggered vertically from one another. In this manner, the back member 22 is held flush against the outer wall 12, even when the outer wall 12 has a slight degree of curvature or is slightly longitudinally undulating. The elongated shape of each of the apertures 48, 49 and 50 further allows for the thermal expansion of the hanger member 18 after the hanger member 18 is fixedly secured to the outer wall 12 via the external fastening members.

The hanger member 18 is preferably extruded from a thermoplastic, and more preferably from polypropylene. This provides the lower J-channel 30 and the upper lip member 34 with a degree of flexibility which enables these members to flex slightly when the molded dentil insert member 20 is secured to the hanger member 18. This process will be described in detail momentarily.

Figure 6:
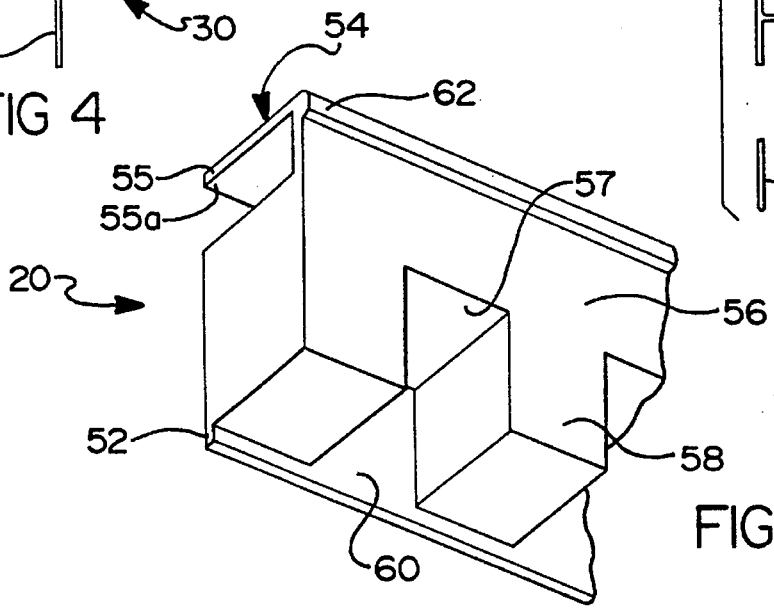
FIG. 6 is a perspective view of a portion of the molding insert member.

With reference to FIG. 6, the molded dentil insert member 20 includes a first or planar, lower edge portion 52 and a second or upper L-shaped portion 54 having an upper wall 55. The L-shaped portion 54 and the lower edge portion 52 are separated (i.e., spaced apart) by a main body portion 56 having a vertically protruding wall 57. The main body portion 56 includes a plurality of block-like dentil protrusions 58 protruding from a base wall portion 60. It will be appreciated immediately that the particular dimensions of the dentil block wall portions 58 and the shape of same may vary significantly and that the generally rectangular dentil block portions 58 shown in FIG. 6 is for illustrative purposes only. The dentil protrusions 58 could just as easily be formed from triangularly shaped protrusions, semi-circular protrusions or a wide variety of other distinctive and decorative appearing shapes.

With further reference to FIGS. 6–8, the L-shaped portion 54 includes a shoulder portion 62 formed thereon which extends preferably substantially the entire length of the insert member 20. The lower edge portion 52 also preferably extends along the entire length of the insert member 20. It will be appreciated, however, that the shoulder portion 62 need not be continuous along the entire length of the insert member 20. Instead, a plurality of spaced apart shoulder portions could be incorporated which would slightly reduce the amount of material needed to form the insert member 20, but would still allow the member 20 to be securely affixed to the hanger member 18.

Referring now to FIGS. 2 and 9–12, an alternative preferred embodiment 10' of the molding apparatus of the present invention is shown. It will be appreciated that the embodiment 10' is identical to the molding apparatus 10 with the exception of the shape of the decorative dentil blocks 58', which are larger than the dentil blocks 58 shown in FIGS. 2, 6 and 7. Accordingly, reference numerals identical to those used to denote the various portions of the molding apparatus 10 will be used with the drawings of FIGS. 9–12, but with a "prime" indication for the molding insert member 20' and its various sub-components. Since the hanger member of the molding apparatus 10' is identical in all respects to the hanger member 22 of FIGS. 3, 4 and 5, identical reference numerals will be used to identify the hanger member and portions thereof of the molding apparatus 10'.

Referring further to FIGS. 9–12, the molded dentil insert member 20' is shown secured to the hanger member 18. With specific reference to FIG. 12, the molded dentil insert member 20 is first positioned relative to the hanger member 18 such that the lower edge portion 52' is positioned within the first channel 32 formed by the lower J-channel 30. A slight inward and downward force in accordance with directional arrow 64 is then applied to the insert member 20' which causes the lower J-channel 30 to flex downwardly and towards the lower portion 26 generally in accordance with the direction indicated by directional arrow 64, as shown specifically in FIG. 12. While the downward force is being exerted on the insert member 20', the insert member is rotated counterclockwise in the drawing of FIG. 12 in accordance with directional arrow 66 such that the upper wall 55' is urged into the second channel 40. Since the upper lip member 34 is somewhat flexible, it flexes upwardly slightly in accordance with directional arrow 68 such that the upper wall 55' clears the outer lip member 38 when entering the second channel 40.

With particular reference to FIGS. 10 and 11, when the downward and inward pressure on the insert member 20' is released, the insert member 20' is urged upwardly by the lower J-channel 30 such that the upper wall 55 of the insert member 20' is captured within the second channel 40. When fully inserted into the second channel 40, a distal portion **55*a*' of the upper wall 55' rests within the second groove 46, while the shoulder portion 62' rests within the groove 42 in the upper lip member 36. The inner lip member 36 serves to help guide the distal portion 55*a*' of the upper wall 55' into the second groove 46 when the wall member 55' is rotated into the second channel 40 by helping to guide the distal portion 55*a*' into the second groove 46. Thus, the dentil insert member 20' is supported at both its lower edge portion 52 and its upper L-shaped portion 54' along its entire length by the hanger member 18**.

It will be appreciated that the above method of securing the dentil molding insert member 20' to the hanger member 18 represents a significant improvement over prior developed hanger arrangements where a molding is required to be secured by external fasteners such as nails, staples, threaded screws or the like to a wall after another end portion is inserted within some form of channel. The molding apparatus 10' of the present invention thus requires no external fastening elements or fastening steps involving the use of external threaded fasteners once the hanger member 18 is secured to an internal or external wall portion. In the event the insert member 20' needs to be removed, removal is easily accomplished by simply flexing the lower J-channel 30 downwardly in accordance with the directional arrow 64 in FIG. 12, and then pulling the member 20' outwardly away from the wall on which the hanger 18 is mounted.

The molding apparatuses 10 and 10' of the present invention further enable decorative molding strips to be quickly and easily attached without the need for special tools and without requiring patching of holes typically required when hardwood or urethane foam moldings are installed. Since the components 18 and 20,20' of the molding apparatuses 10 and 10' are manufactured from relatively high strength, yet flexible, plastics, the individual components 18 and 20,20' are not subject to shrinkage, warpage and the general wear which would normally be experienced by molding strips manufactured from hardwood. The molding apparatuses 10 and 10' of the present invention can further be assembled to an interior or exterior wall of a building or a residential home quickly and easily by relatively inexperienced personnel.

Figure 13:
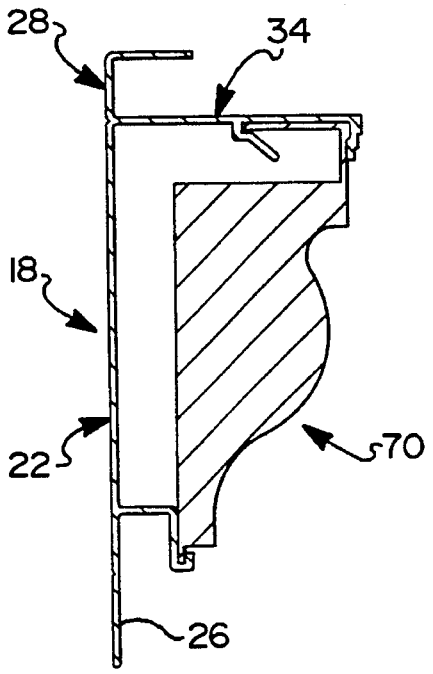
FIG. 13 is a side view of a ogee molding assembly in accordance with an alternative preferred embodiment of the molding assembly of the present invention.

With brief reference to FIG. 13, a molded insert member 70 having an "ogee" profile or curvature is shown in accordance with an alternative preferred embodiment of the insert member. It will be appreciated from FIG. 13, then, that the outward contour of the insert members 20,20' and 70 can very widely to form a variety of aesthetically appealing shapes and/or designs.

Figure 14:
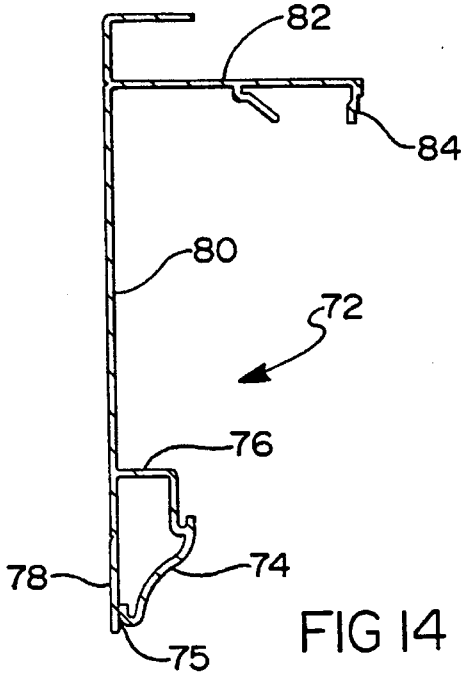
FIG. 14 is a hanger member in accordance with an alternative preferred embodiment of the present invention.

With brief reference to FIG. 14, an alternative preferred embodiment 72 of the hanger member of the present invention is shown. The hanger member 72 forms a cove decorative trim having an undersil 74 extending between a lower J-channel 76 and a lower portion 78 of a back member 80 of the hanger member 72. The undersil 74 further has an edge portion 75 adapted to retain an upper edge portion of a portion of a vinyl siding strip extending longitudinally below the hanger member 72. It will be appreciated then that the hanger member of the present invention could include variously shaped and aesthetically appealing surface contours depending upon the specific appearance desired. It will also be appreciated that an upper lip member 82 of the hanger member 72 could be formed such that an outer lip member 84 thereof has a curvature different from that shown in FIG. 13 to provide an alternative aesthetic appearance.

Figure 15:
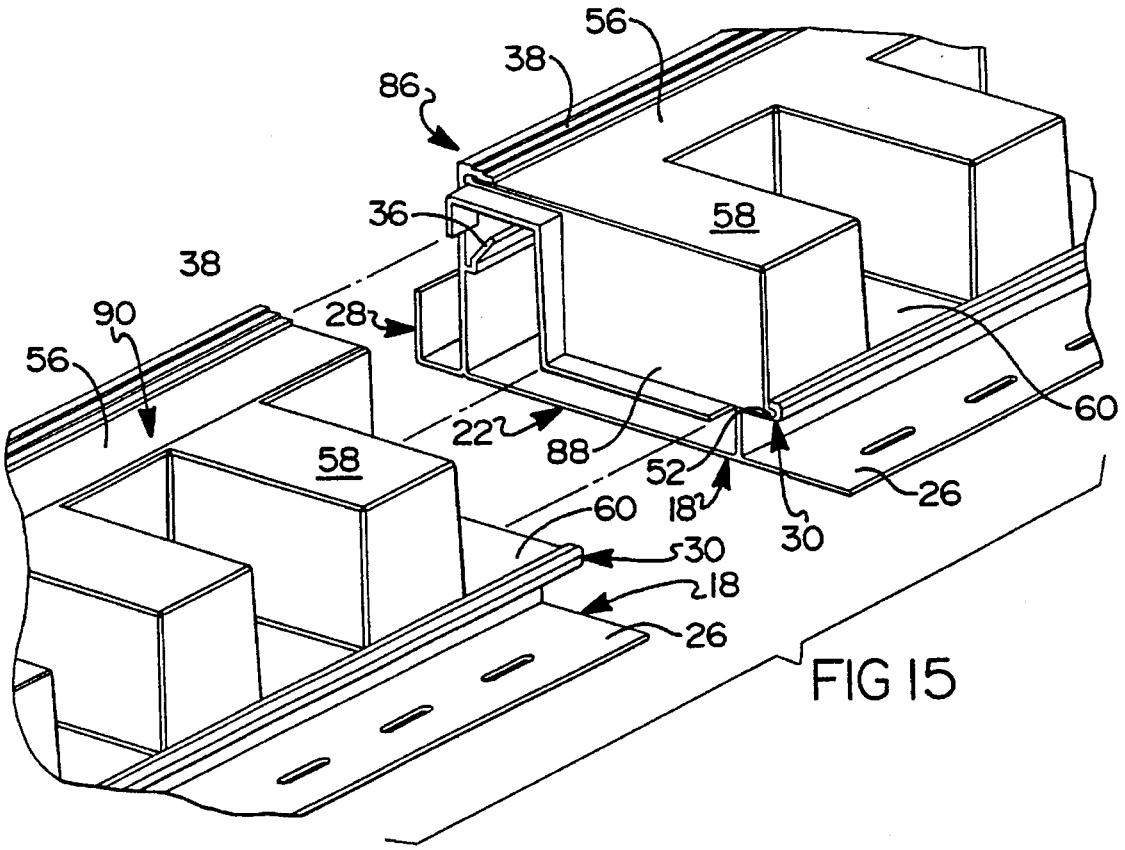
FIG. 15 is an exploded perspective view of an alternative preferred embodiment of the present invention with the molding insert member including an edge-protruding lip adapted to slidably fit underneath an adjacently positioned molding insert member.

With reference to FIG. 15, a dentil molding insert member 86 in accordance with an alternative preferred embodiment of the present invention is shown. The insert member 86 is identical to the insert member 20 of FIGS. 6–8 with the exception of an edge-protruding lip 88. Thus, the elements of the embodiment 86 which are common to those of the insert member 20 in FIGS. 6–8 have been denoted by the same reference numerals as those used with FIGS. 6–8.

The edge-protruding lip 88 is adapted to slidably engage underneath an adjacently positioned second insert member 90 (also identical to insert member 20 in construction) to help interlock the adjacently positioned insert members 88 and 90. By interlocking adjacent insert members, an even more continuous appearing decorative molding insert member is formed. In practice, each insert member 86 could be formed with an edge-protruding lip which is adapted to be easily removed in the same manner as the lower portion 26 of the hanger member 22 in FIGS. 4 and 5, in the event the edge-protruding lip 88 is not needed, such as when the member 86 abuts a perpendicularly extending wall portion.

Figure 16:
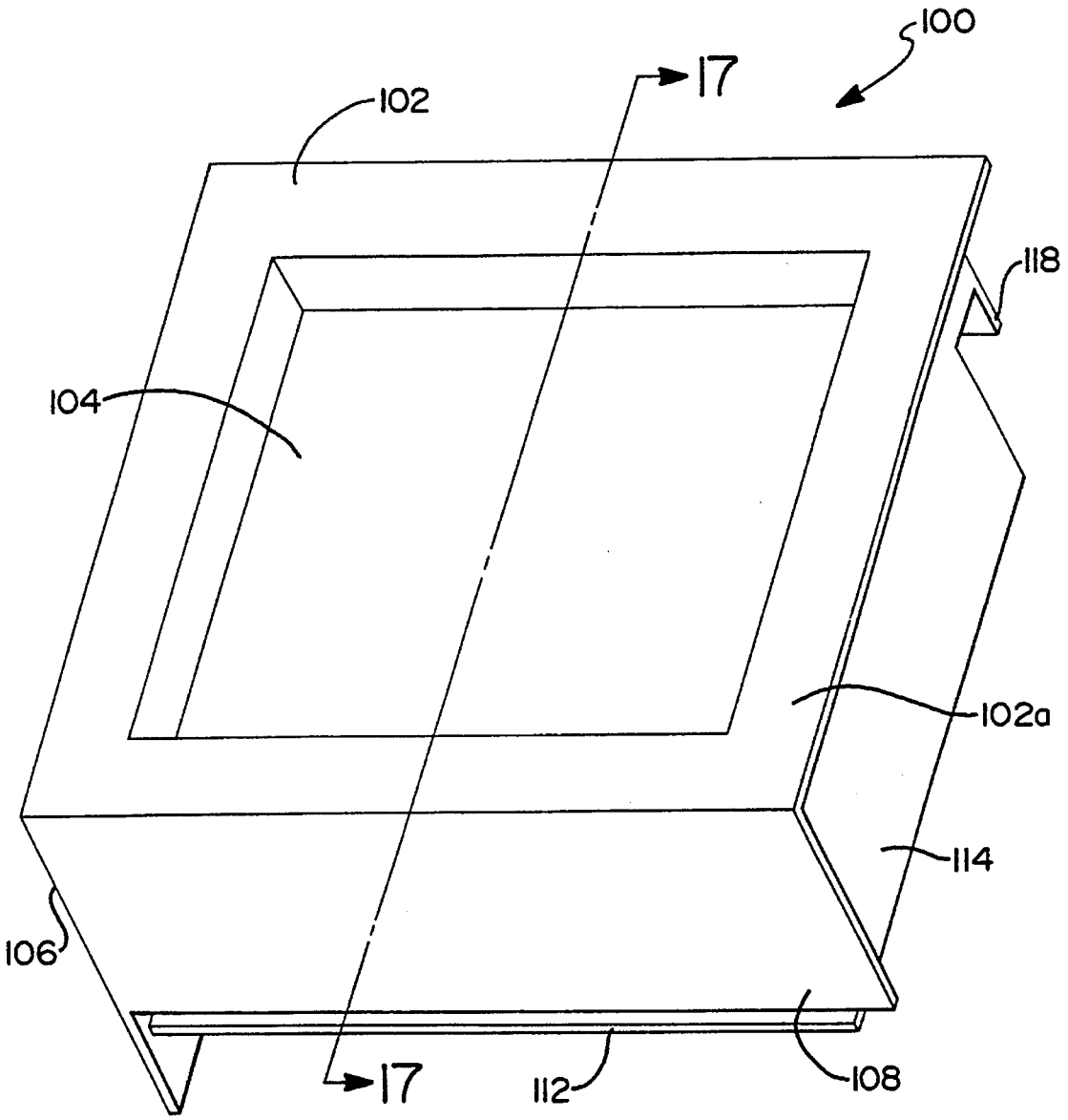
FIG. 16 is a perspective view of an end cover in accordance with a preferred embodiment of the present invention.

Referring now to FIG. 16, an end cover 100 for use with the various preferred embodiments of the molding apparatus of the present invention is shown. The end cover 100 is adapted to close-off an exposed end portion of a molding apparatus such as apparatus 10 whenever one end or the other of the molding apparatus 10 does not abut a perpendicularly extending wall, and therefore would otherwise be exposed to view. The end cover 100 includes a face portion 102 having a recess 104 formed centrally therein. It will be appreciated immediately, however, that instead of a generally square shaped recess, virtually any shaped recess or even a decoratively shaped protruding portion could be formed on the face portion 102 depending upon the decorative appearance desired. Accordingly, recessed or protruding squares, circular designs or various other designs could be formed on the face portion 102.

Figure 17:
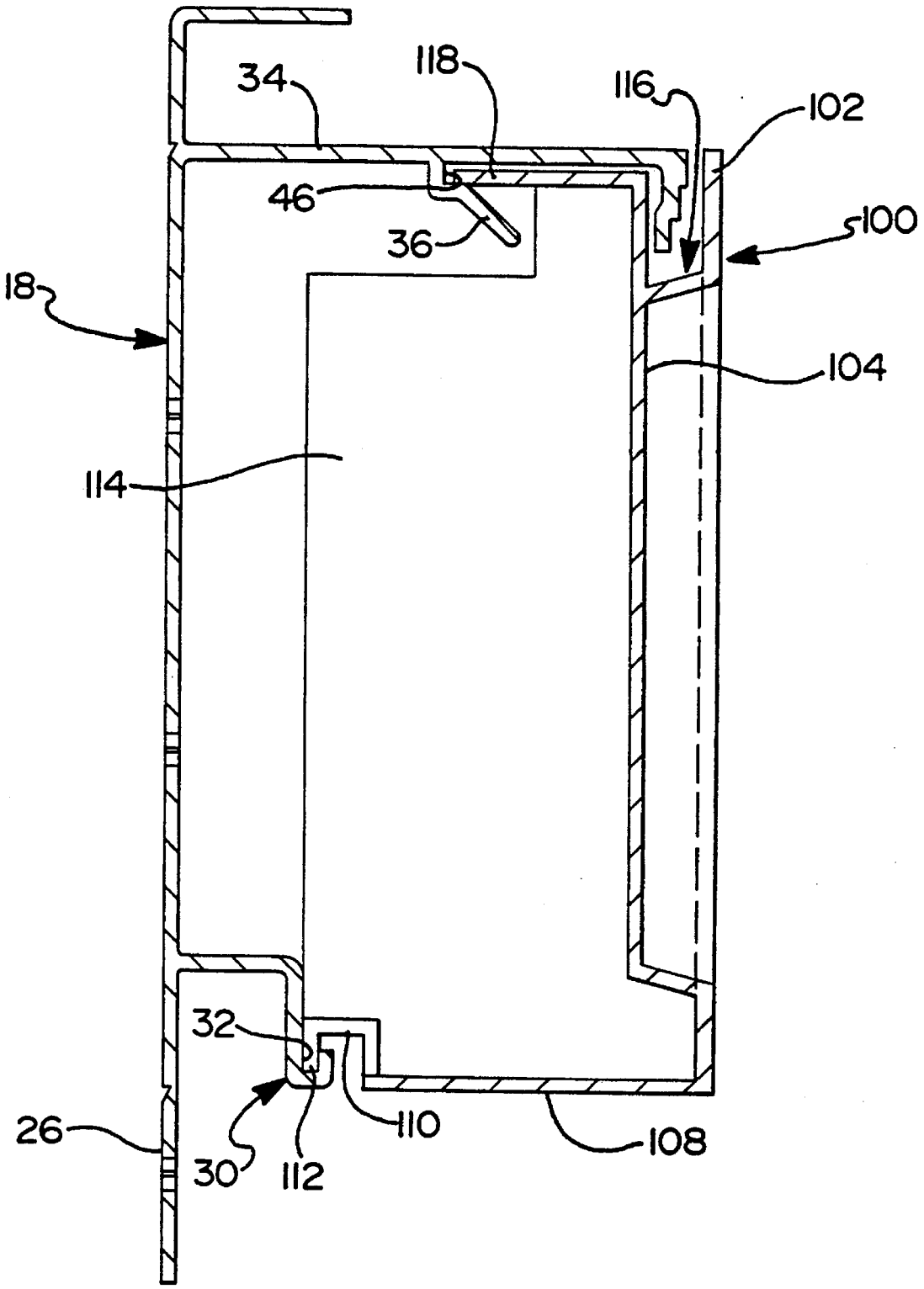
FIG. 17 is a cross-sectional side view of the end cover of FIG. 16 in accordance with section line 17—17 in FIG. 16 showing the end cover secured to one preferred embodiment of the hanger member of the present invention.

With further reference to FIGS. 16 and 17, the end cover 100 is shown releasably secured to the hanger member 18. The end cover 100 further includes an outer side surface 106

(FIG. 16), a lower wall portion 108, a lower support channel 110 (FIG. 17) having a depending lip portion 112, a vertical wall portion 114 and an upper channel 116 (FIG. 17) formed in part by an upper lip member 118 extending generally transversely of the face portion 102. A portion 102*a* of the face portion 102 extends past the vertical wall portion 114 such that it overlaps a portion of a terminal end of a decorative insert member, such as insert member 20, when secured to a hanger member, such as hanger member 18, which supports the insert member 20. The vertical wall portion 114 is adapted to be abutted against the terminal (i.e., exposed) end of the insert member 20. The outer side surface 106 abuts the terminal end of the hanger member 18 to close-off the terminal end.

With brief reference to FIG. 19, the outer side surface 106 can be seen to have a longitudinal width which is sufficient to extend past (i.e., behind) the lower support channel 110 such that when the end cover 100 is secured to a hanger member in accordance with the present invention, the ends of the hanger member and decorative molding insert members secured thereto will not be visible once the end cover 100 is secured to the hanger member. This is because an upper edge 106*a* of the outer side surface 106 is adapted to abut a soffit, ceiling or other protruding wall portion, while a rear edge surface 106*b* is adapted to abut a wall portion to which the hanger member of the present invention is secured.

With further reference to FIG. 17, the upper lip member 118 engages within the second groove 46 of the hanger member 18. The lip portion 112 engages within the first channel 32. The end cover 100 is further inserted in accordance with the assembly steps described hereinbefore such that the end cover 100 is releasably secured to the hanger member 18.

The end cover 100 may be formed from a variety of manufacturing techniques, but preferably is injection molded from a thermoplastic, preferably polypropylene, to form a relatively inexpensive, yet relatively strong and lightweight member which is well adapted to provide a decorative member for closing off an exposed end portion of the molding assembly 10.

Referring now to FIG. 20, an end cover 200 in accordance with an alternative preferred embodiment of the present invention is shown. The end cover 200 is identical to the end cover of FIGS. 16–19 with the exception of a shoulder portion 202 which is formed at one end of a lip portion 204 of a lower support channel 206. The end cover 200 otherwise includes a face portion 208, a recessed portion 210, an outer side surface 212, a lower wall portion 214, a vertical wall portion 216, an upper channel 218 and an upper lip member 220.

Referring to FIG. 21, a hanger member 222 is shown in accordance with an alternative preferred embodiment of the present invention. The hanger member 222 is essentially identical to the hanger member 18 of FIGS. 2–5 with the exception of a notch 224 which is formed in a lip portion 226 of a lower J-channel 228. Otherwise, the hanger member 222 is identical in construction to hanger member 18 shown in FIGS. 2–5, and generally includes a back member 230 having a central portion 232, an optional lower portion 234, a soffit-engaging upper lip portion 236 and a depending upper lip member 238. The depending upper lip member 238 includes an inner lip member 240 and an outer lip member 242 which together help to form a second channel 244. The central portion 232 also includes a plurality of spaced apart and elongated apertures 246, while the lower portion 234 similarly includes a plurality of elongated, spaced apart apertures 248.

With specific reference to FIGS. 22–24, the construction of the end cover 200 can further be seen as being identical to the end cover 100 with the exception of the shoulder portion 202 which forms a continuous portion of the vertical wall portion 216.

Referring to FIGS. 25–27, the end cover 200 is shown assembled to the hanger member 222. With specific reference to FIG. 26, the shoulder portion 202 is shown engaged within the notch 224 of the lip portion 226 of the lower J-channel 228. With reference to FIGS. 26 and 27, an edge portion 250 of the lower wall 214 abuts the lip portion 226 of the lower J-channel 228 when the end cover 200 is releasably secured to the hanger member 222.

The shoulder portion 202 and notch 224 of the end cover 200 and the hanger member 222, respectively, cooperate to prevent the end cover 200 from being urged slidably off of the hanger member 222 by thermal expansion of one or more sections of molding insert members such as insert member 20. Accordingly, once the end cover 200 is releasably secured to the hanger member 222 in the manner hereinbefore described with respect to the previously disclosed embodiments, the end cover 200 can only be removed by manually urging it outwardly of the hanger member 222 such that the lip portion 220 disengages the channel 244, and then subsequently removing the lip portion 206 from the lower J-channel 228.

It will be appreciated that all of the preferred embodiments described herein could be manufactured from polystyrene to obtain a complete molding assembly which is readily paintable or stainable.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed:

1. A molding apparatus comprising:

an elongated hanger member having a substantially planar back member adapted to be fixedly secured directly to a wall by at least one external fastening element;

said hanger member having a first channel and a second channel each protruding outwardly of said back member, said second channel being spaced apart from said first channel; and a molding insert member having a first portion extending in a first direction from a first surface and a second portion extending in a second direction generally opposite to said first direction from a second surface spaced apart from said first potion, wherein said first potion is adapted to engage within said first channel and said second potion is adapted to engage within said second channel to attach said insert member to said hanger member without independent fastening elements.

2. The apparatus of claim 1, wherein said first channel is formed by a depending lower lip member forming a J-channel extending along at least a portion of the length of said back member.

3. The apparatus of claim 2, wherein said back member and said lower J-channel are integrally formed.

4. The apparatus of claim 1, wherein said hanger member comprises:

said elongated back member adapted to be attached to said wall;

an upper lip member protruding outwardly of said back member and integrally formed with said back member; and said upper lip member being at least slightly flexible and including a depending inner lip member and an outer lip member, said inner and outer lip members forming said second channel within which said second portion of said insert member is releasably attached.

5. The apparatus of claim 1, wherein said first portion comprises a planar, elongated edge portion adapted to engage said first channel of said hanger member and said second portion comprises an L-shaped portion adapted to engage within said second channel.

6. The apparatus of claim 5, wherein said L-shaped portion includes a shoulder portion integrally formed thereon; and wherein said second channel comprises an upper lip member and an elongated groove formed at least partially on said lip member for accepting said shoulder portion when said L-shaped portion is engaged within said second channel.

7. The apparatus of claim 1, wherein said hanger member comprises:

said member having a central portion adapted to be secured against said wall and a lower portion extending longitudinally past said first channel; and at least one of said central portion and said lower portion having at least one aperture for allowing said back member to be secured to said wall.

8. The apparatus of claim 1, wherein said back member comprises an upper lip integrally formed therewith for engaging a soffit member positioned adjacent said wall.

9. The apparatus of claim 8, wherein said back member and said upper lip member are integrally formed.

10. The apparatus of claim 1, wherein said insert member includes a lip adapted to engage an adjacently positioned second insert member.

11. The apparatus of claim 10, further comprising an end cover member adapted to slidably engage said edge-protruding lip to thereby close-off an exposed end portion of said molding apparatus.

12. A decorative molding apparatus comprising:

a hanger member having a back member adapted to be fixedly secured to a wall by at least one external fastening element;

a decorative molding insert member adapted to be secured to said hanger member without the need for independent fastening members;

said back member having a lower J-channel and an upper lip member protruding outwardly therefrom at spaced apart locations along said back member, said lower J-channel forming a first channel said upper lip member including a depending inner lip member and a depending outer lip member forming a second longitudinally extending channel spaced apart from said first channel;

said inner member including a first edge portion adapted to engage within said first channel and a second L-shaped portion spaced apart from said first edge portion adapted to engage within said second channel to thereby secure said insert member at more than one area to said hanger member without the need for external fastening elements; and wherein said hanger member includes a soffit-engaging upper lip for inter-engaging with a soffit member when said back member is secured against said wall.

13. The apparatus of claim 12, wherein said back member includes a central portion and a lower portion; and wherein one of said central portion and said lower portion includes a plurality of spaced apart apertures for allowing said hanger member to be secured to said wall via a plurality of independent fastening members.

14. The apparatus of claim 12, wherein said lower J-channel and said upper lip member are flexible.

15. The apparatus of claim 12, wherein said hanger member is extruded from a thermoplastic to form an elongated hanger member.

16. The apparatus of claim 15, wherein said hanger is extruded from polypropylene.

17. The apparatus of claim 12, wherein said insert member is formed from a thermoplastic.

18. The apparatus of claim 17, wherein said insert member is formed from polypropylene.

19. The apparatus of claim 12, wherein said insert member is injection molded.

20. The apparatus of claim 12, wherein said insert member is vacuum formed.

21. The apparatus of claim 12, wherein said apparatus is formed from polystyrene.

22. The apparatus of claim 12, wherein said molding insert member further comprises an edge-protruding lip adapted to slide behind a portion of an adjacently positioned second insert member also secured to said hanger member.

23. The apparatus of claim 22, further comprising an end cover adapted to slidably engage an exposed end portion of said molding apparatus to thereby close-off said exposed end portion.

* * * * *